United States Patent [19]

El Hassen

[11] Patent Number: 4,646,367

[45] Date of Patent: Mar. 3, 1987

[54] TUMBLING CAP

[76] Inventor: Moulaye O. El Hassen, C/ Clara del Rey, 71, 28002 Madrid, Spain

[21] Appl. No.: 753,121

[22] Filed: Jul. 9, 1985

[30] Foreign Application Priority Data

Jan. 10, 1985 [ES] Spain ..... 283884

[51] Int. Cl.[4] ..... A42B 3/02

[52] U.S. Cl. ..... 2/411; 2/171; 2/412; 2/DIG. 11; 128/380; 128/384

[58] Field of Search ..... 2/410, 411, 412, 170, 2/171, DIG. 11; 128/163, 380, 384

[56] References Cited

U.S. PATENT DOCUMENTS

| | | | |
|---|---|---|---|
| 1,434,854 | 11/1922 | Stall | 2/171 |
| 2,160,567 | 5/1939 | Sterne | 2/171 |
| 2,223,332 | 11/1940 | Sterne | 2/171 |
| 4,521,922 | 6/1985 | Mitchell et al. | 2/171 |
| 4,538,301 | 9/1985 | Sawatzki et al. | 2/411 X |

FOREIGN PATENT DOCUMENTS

| | | | |
|---|---|---|---|
| 2390116 | 1/1979 | France | 2/412 |
| 2134370 | 8/1984 | United Kingdom | 2/411 |

*Primary Examiner*—Werner H. Schroeder
*Assistant Examiner*—J. L. Olds
*Attorney, Agent, or Firm*—Ladas & Parry

[57] ABSTRACT

This invention relates to a tumbling cap comprising an elastic type band with a perimeter slightly smaller than that of the user's head. A series of padded parts are mounted on the elastic band at closely spaced intervals.

3 Claims, 2 Drawing Figures

FIG. 1
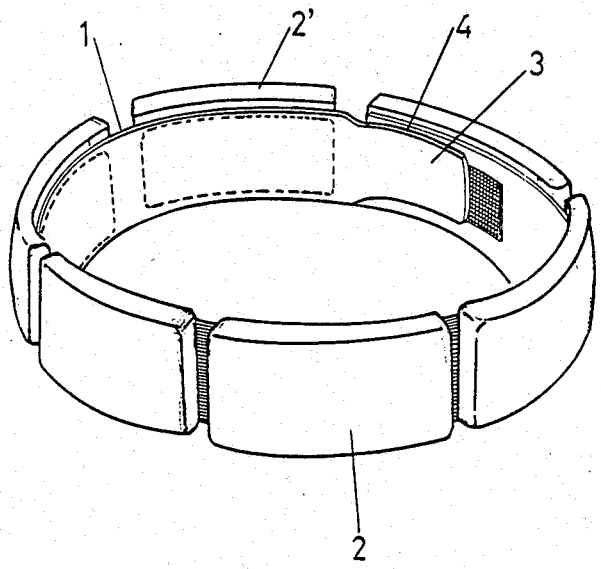
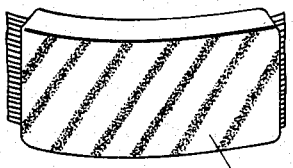
FIG. 2

TUMBLING CAP

BACKGROUND OF THE INVENTION

The present invention relates to a tumbling cap, designed to be fitted to a child's head, in such a way that it remains fastened to the same and so that it acts as a protective device.

The invented tumbling cap is designed to protect small children's heads against knocks on their forehead, sides and back of the head.

Besides, the invented tumbling cap has been designed in such a way that it can be easily fitted and fastened to one's head, without causing any discomfort that causes little children to take off the protective device.

SUMMARY OF THE INVENTION

The invented tumbling cap is made out of an elastic type band or strip, which defines a perimeter slightly smaller than the perimeter of the user's head. In this way, upon fitting the tumbling cap on a child's head it will have to become elastically deformed to an extent that suffices to achieve its perfect fit.

Fastened to the outside surface of said elastic band or strip, all around it there is a series of parts of a padded nature, close to each other, of a width preferably equal to the width of said band or strip. These parts of a padded nature will be used as parts that protect against knocks. Preferably said padded parts will be made out of dense foam rubber and will be lined with a sheet of waterproof, flexible plastic material, so that it may be washed without it becoming spoiled.

The padded parts may be fastened to the elastic strip or band by any system.

In accordance with another feature of the invention, the elastic strip or band will be preferably open on and will extend on one side beyond one of the end padded parts, in a part provided with methods of fastening to the inside surface of the opposite end section.

In this way a perfect adjustment of the length of the perimeter defined by the band or strip is attained, adapted to the small child's head, in such a way that it remains fastened to the same without it producing excessive pressure.

BRIEF DESCRIPTION OF THE DRAWINGS

The structure and features of the invented tumbling cap will be more easily understood with the following description, made referring to the appended drawing, wherein FIG. 1 is a possible form of construction shown in a perspective view, given as a non-restrictive example.

FIG. 2 shows a perspective view of the padded elements of the present invention.

DESCRIPTION OF THE PREFERRED EMBODIMENTS

As it can be observed in FIG. 1, the tumbling cap is made up of an elastic type band or strip no. 1, large enough to define a perimeter slightly smaller than the perimeter of the user's head, in such way upon fitting the tumbling cap to a child's head, the strip or band no. 1 remains slightly elastically deformed so that it is securely fastened.

The elastic strip or band no. 1 has fastened to its outside surface, all around it, a series of padded parts no. 2, close to each other. These padded parts no. 2 act as protective devices against knocks and they may be made out of dense foam that will also be lined with a sheet of waterproof, flexible, plastic material that may be washed without the risk of it becoming spoiled.

Since the outside protection is made up of the independent parts no. 2, this unit is flexible and fits perfectly around one's head. On the other hand, since the space between the consecutive parts is small, the entire perimeter of one's head will be protected without any risk that any knock may directly act on the elastic strip or band no. 1.

The padded parts no. 2 may be as wide or a little wider than the elastic band or strip no. 1.

In the example represented in the drawing, the elastic band or strip no. 1 is open and one end extends beyond the end padded part no. 2' in a part or tongue no. 3 where outside surface is provided with means of fastening to the inside surface of the opposite end part no. 4. For example, these means may consist of adherent padded coverings that make a secure fastening possible. With this structure, the perimeter defined by the strip or band no. 1 adjusts to the size of the perimeter of the small child's head, in such a way that secure fastening is achieved by partial elastic deformation of the strip or band no. 1.

The strip or band no. 1 could also be continuous, defining a closed perimeter, sized to elastically fit around the small child's head.

With the described structure, a protective elastic band for one's head, padded on its outside surface, easily adjustable and adaptable to the perimeter of one's head that will serve to cushion knocks or blows that a child may receive on his forehead, sides and back of his head.

The tumbling cap is fastened by means of the pressure that the elastic band or strip no. 1 will exert on the perimeter of the child's head; in the example represented in the drawing it may be adjusted thanks to the length of the tongue or end part no. 3, while in the exmaple in which the perimeter of the tumbling cap is closed, this will be achieved by the elasticity of the strip or band no. 1.

The padded parts no. 2 will be able to be fastened by any method or means to the elastic strip or band no. 1, either directly or by means of the covering of said parts.

Decorations amy be put on the sides of the strip, as well as on the outside surface of the parts no. 2 so that the unit turns out to be appealing.

Having sufficiently described the nature of the invention as well as the way to make it in practice, it must be stated that the features indicated above are susceptible to modification of detail as long as they do not alter its basic principle.

Having thus described the invention what is claimed as new and desired to be secured by Letters Patent is as follows:

1. A tumbling cap, comprising an elastic type band or strip which defines a perimeter slightly smaller than the perimeter of the user's head, said elastic band including a series of parts of a padded nature which are mounted on and which substantially surround the entire outer circumferential surface of said elastic band, said parts being closely spaced at equidistant intervals.

2. A tumbling cap, in accordance with claim 1, wherein said band is open and has two ends, one of which extends beyond one of the padded parts, said extended end of said band being shaped as a tongue provided with means of fastening to the inside surface of an opposite surface of said band.

3. A tumbling cap, in accordance with claim 1, wherein the padded parts are made up of dense foam rubber, lined with a sheet of waterproof, flexible, plastic material.

* * * * *